United States Patent [19]

McIntyre et al.

[11] 4,189,510

[45] Feb. 19, 1980

[54] REPLACEMENT PLATING PROCEDURE FOR SILVER ON NICKEL

[75] Inventors: James A. McIntyre; Robert F. Phillips, both of Midland; Joseph D. Lefevre, Bay City, all of Mich.

[73] Assignee: The Dow Chemical Company, Midland, Mich.

[21] Appl. No.: 939,587

[22] Filed: Sep. 5, 1978

[51] Int. Cl.[2] ..... B05D 1/18; C23C 3/00; C23F 1/00

[52] U.S. Cl. ..... 427/125; 427/247; 427/304; 427/309

[58] Field of Search ..... 427/125, 247, 304, 309

[56] References Cited

U.S. PATENT DOCUMENTS

| | | | |
|---|---|---|---|
| 3,123,484 | 3/1964 | Pokras et al. | 106/1 |
| 3,539,469 | 11/1970 | Schroeder et al. | 252/474 |
| 3,787,244 | 1/1974 | Schulmeister et al. | 136/120 FC |
| 3,880,730 | 4/1975 | Wright et al. | 204/46 G |

OTHER PUBLICATIONS

Wright et al., C. A. 68059v, vol. 83, 1975.

*Primary Examiner*—James R. Hoffman

[57] ABSTRACT

A porous nickel body is interiorly silver plated in a two-step procedure by: first, acid etching the nickel surface for activation; then plating the activated surface by replacement of elemental nickel thereon with silver from a dissolved aqueous cyanide or equivalent silver salt.

10 Claims, 1 Drawing Figure

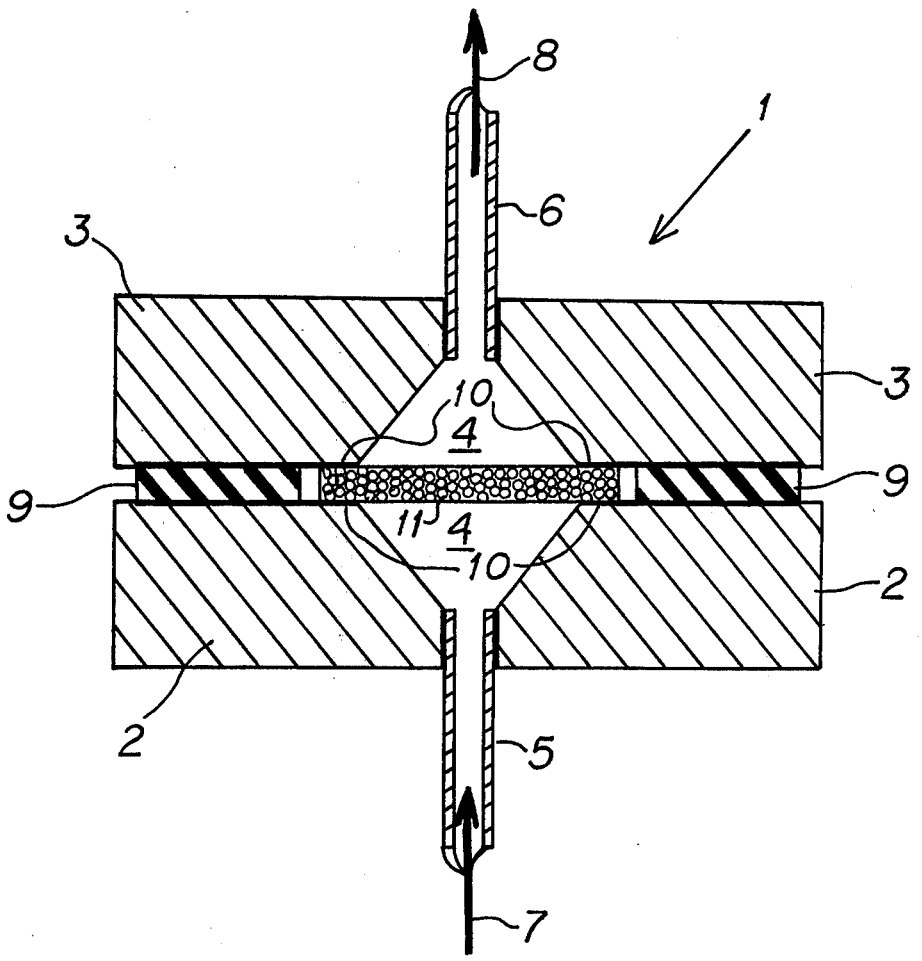
8
1
6
3
3
10
4
9
9
11
4
10
2
2
5
7

REPLACEMENT PLATING PROCEDURE FOR SILVER ON NICKEL

BACKGROUND OF THE INVENTION

Porous nickel bodies are difficult to satisfactorily interiorly silverplate. The problem intensifies with increasing diminishment of the void spaces involved, about which the plating deposit is desired to be made on the enclosing wall surfaces thereof. This is particularly so in cases where the body to be interiorly plated is a porous electrode intended for usage electrochemically. Characteristically, these contain an abundance of exceedingly fine, internal body-traversing pores which oftentimes are of minuscule size on the order of 10–25 microns and less to as small as even 0.1 micron or so.

Attempts to overcome the mentioned difficulty have not met with general success nor have they been without certain inherently unattractive features and limitations.

For example, U.S. Pat. No. 3,539,469 discloses a replacement plating process for acid treated nickel powders to be subsequently fabricated into electrode bodies for fuel cells and so forth. However, the therein taught technique neither contemplates nor includes plating of fabricated porous bodies and, in addition, requires application of considerable, relatively costly quantities of silver for the plating of the particles on the usual order of from 10–30 weight percent.

U.S. Pat. No. 3,787,244 involves use of a single, one-stage application acid/noble metal salt solution for catalytic plating of various porous metal electrode bodies, including those of nickel. Such a reagent is generally inoperable for silver plating purposes due to involved insolubility problems with the silver salts in the highly acidic (i.e., pH 0.5–2), simultaneously dual-functioning solutions employed.

FIELD AND OBJECTIVES OF THE INVENTION

The present invention concerns metal deposition, being more directly relevant to the interior silver plating of various porous nickel bodies, particularly finely pored structures including electrochemical electrodes, in such a way as to achieve in adequately effective laid quantities maximized proficiency in securement of efficiently and uniformly thin silver plated layers on interior nickel body surfaces; the attainment and provision of same being amongst the principal aims and objectives of the invention.

SUMMARY OF THE INVENTION

This invention is directed to a two-step procedure for replacement plating silver on at least the interior surface areas of a porous nickel substrate body comprising: as the first step, etching the surface areas of the porous nickel body over which silver plate is to be laid with an aqueous solution of a mineral acid capable of removing oxide deposits from the nickel on bare elemental nickel on said surface areas to activate same; then subsequently and as the second step, contacting the activated nickel surface areas with an aqueous plating solution of a silver salt capable of laying silver plate by displacement of nickel in the substrate and replacement thereof with silver from the solution; it being advantageous to include, in addition thereto and in combination therewith, a thorough water washing of the acid etched body as part of said first step to render it free from acid prior to performance of said second plate laying step.

Salient particulars and significant specifics relevant to embodimentation of the invention are ingenuously delineated in the ensuing Specification and description.

ILLUSTRATED REPRESENTATION OF THE INVENTION

Further features and characteristics of the porous nickel body silver plating development in accordance with the present invention are even more readily apparent and evident in the following Specification and description when taken in conjunction with the accompanying Drawing, wherein the sole FIGURE is a fanciful sort of cross-sectional elevation view which, in a very simple style, illustrates one apparatus assembly in which there may be conducted one technique for implementing the invention.

PARTICULARIZED DESCRIPTION OF THE INVENTION

For purposes of further illustration and to show in an elementary demonstrative fashion one way of carrying out the present procedure, reference is now had to the accompanying Drawing.

The presently contemplated two-step replacement plating procedure may be conducted in an apparatus assembly, generally identified by the reference numeral 1. The assembly 1 has clamping holder elements 2 and 3 therein held together by means (not shown) which urge one against the other. A central hollow chamber 4 is formed by matching hollowed out portions or cavities of the holder elements 2 and 3. A liquid inlent conduit 5 leads to chamber 4 through holder element 2 and an outlet conduit 6 in holder element 3 evacuates the chamber. Influent is admitted through inlet conduit 5 in the feeding direction of the arrow identified by reference numeral 7. Effluent is withdrawn from chamber 4 through outlet conduit 6 in the exhausting direction of the arrow identified by reference numeral 8. A rubber (or the like) gasket 9 separates and spaces holder elements 2 and 3 and seals cavity 4. Gasket 9 also assists in the mounting of the porous nickel body 11 to be silver plated which, in the depicted illustration, is a finely-pored electrode having a generally circular, planar body configuration. The body 11 is mounted upon and carried by the seat portions 10 of the respective holder members 2 and 3 between which the body is clamped and held in place for receipt of the two-step replacement plating operation of the invention.

While the exact positioning of the apparatus 1 is usually immaterial, it is sometimes convenient to have it so placed (and as is shown in the Drawing) that the influent proceeds vertically upwards therethrough.

The procedure, simply enough and as indicated, is to first activate the porous metal body by means of a suitable mineral acid treatment which is ordinarily followed by thorough washing with water to remove all traces of acid; then, with complete immersion of the porous body, to apply to and through the interstitial passageways of the activated metal body surface the silver plating solution. Advantageously, this may be of the cyanide variety. The replacement plating of the immersed body is thereupon accomplished by displacement of the substrate nickel by the more noble silver from the plating solution. A final wash (ordinarily aqueous) and drying, as in air, ordinarily completes the operation.

The washing following the acid etch is important. It tends to ensure avoidance of unwanted and deleterious acid precipitation of silver salts and, particularly when effective cyanide plating solutions are employed, it positively helps to prevent evolution of deadly hydrogen cyanide (HCN) during the operation.

The acid application to the substrate body can be made in any desired and effective way. Thus, the acid may be directly poured or dropped on the body 11 to thoroughly saturate and wet all the interior voids of same before mounting of the body in the assembly 1 (or an equivalent apparatus). Washing may likewise be done before mounting to render the porous body in a suitably free-from-acid condition for the subsequent plating step. Oftentimes, however, the acid etch treatment and water wash can more conveniently and expeditiously be done in the assembly 1, particularly when satisfactory corrosion-resisting materials are employed for assembly construction.

In this connection and even though hydrochloric acid (HCl) is frequently preferred for the acid treatment, it is possible to employ for this any mineral acid that is capable of dissolving surface formations of nickel oxide in order to properly activate and leave substantial, if not complete, showings of bare elemental nickel exposed on the interior substrate surfaces of the porous body being handled. These may include such acids as phosphoric, nitric, sulfuric, aqua regia and so forth.

The etching acid concentration should be at least about one (1) Molar up to that which is normal in the generally available industrial grade strengths for any given mineral acid utilized. Although possible to employ, there is no great advantage in utilizing the etching acids in greater strengths than those indicated.

The activating treatment may be done at any desired temperature between ambient and the boiling point of the etching acid that is utilized. Usually, however, the activation proceeds rapidly enough at normal room temperatures to allow satisfactory accomplishment thereof without any necessity of heating the treating acid.

Conventional silver plating solutions can be utilized for the second step of the procedure. For that matter, practically any water soluble salt of silver may be employed for the purpose; it being of course necessary to make the selection so that the salt employed is capable with proper utilization to provide an at least substantially solid and adequately adherent deposit layer on the surfaces being plated. Thus, silver nitrate ($Ag(NO)_3$) may be satisfactorily employed. Advantageously, however and as mentioned, the silver salt employed is silver cyanide (AgCN). When the cyanide salt is utilized, and pursuant to standard practice, it is usually necessary to include some additional alkali metal cyanide salt, such as potassium cyanide (KCN), in the system in order to increase the AgCN solubility (by formation therewith of $Ag(CN)_2^-$). Such plating solutions are, for most practical purposes, almost invariably found to be possessed of excellent plate-throwing capabilities in silver plating operations.

Also according to common practice for silver cyanide plating solutions, it may sometimes by felt permissable for enhanced polarization effects to additionally employ some akali metal carbonate, such as sodium carbonate ($Na_2CO_3$) or potassium carbonate ($K_2CO_3$), in the cyanide plating solution. At other times, however, and as more fully demonstrated below, the replacement plating is not enhanced by use of such an additive.

The cyanide plating solution may be employed in strengths up to the saturation point. It advantageously has a molar ratio of AgCN to KCN (or other alkali metal cyanide) of at least about 1:1, respectively. The indicated minimum Molar ratio facilitates having an optimum cyanide basis in the plating system. If the $Ag^+$ concentration in the plating solution is too low, it tends to permit $CN^-$ attack on the nickel substrate. Thus, maintenance of a relatively high $AG^+$ to $CN^-$ ratio in the plating solution minimizes undesirable $CN^-$ attack on the nickel.

Accordingly, an approximately 1:1 Molar ratio aqueous solution of about 60 g/l AgCN and 30 g/l KCN is generally found to lay good and uniform silver platings on the activated nickel substrate in reasonable short periods of time. Solutions containing as little as 30 g/l AgCN and as much as 75 g/l KCN (or an aliquot proportion of an equivalent alkali metal cyanide) may be tolerated.

As with the etching acid, the plating solution is generally capable of functioning well at room temperature, although temperatures up to and at the boil may also be used for laying of the plating on the nickel substrate interior voids being plated.

Optimum silver plating results in practice of the present invention are generally provided by exercise of very careful control over such particulars of the operation as:

(i) the thorough and well doing of the first acid etching step to ensure an as complete as possible removal of the generally heavy oxide and sometimes other salt formations on substantially if not completely all of the interior surfaces(s) to be plated in the porous nickel body substrate;

(ii) the flow rate of the plating solution being passed through the porous body being interiorly plated, this being governed by the pressure applied (and the resulting pressure drop across the porous body being plated) to the plating solution being forced through the body; plus (iii) treating temperature(s); and (iv) plating solution concentrations(s).

The immediately above Points (i), (iii) and (iv) have been touched upon in the foregoing.

As to Point (ii), it is oftentimes advantageous for the flow rate of the plating solution through the porous nickel body being plated to be on the order of between about 1 and about 25 $cc/cm^2/min$ (the indicated area referring to that of the exposed face or wall of one side of the body); this being particularly the case when plating fine pore sized nickel electrode bodies. Surprising as it may seem, changes in the flow rate of the plating solution frequently result in an entirely different sort of plate laying reaction. Generally, the use of excessive pressure to effect flow rate is undesirable. This is not only because of the undesirably high rate of flow it may consequence, but also because it may tend to cause physical damage, such as cracking, bulging or rupture, of the porous body being treated especially when usually thin and relatively fragile electrode bodies are being handled.

While the porous body to be plated is frequently of substantially pure nickel, those of the other various available nickel forms, compositions and alloys may also be beneficially silver plated in practice of the present invention. Most often, especially when electrodes are involved, the porous body is of a sintered, fabricated powder metal construction.

EXEMPLIFICATION OF THE INVENTION

To demonstrate the advantageous practice of the present invention, a number of flat, porous nickel disc bodies were individually replacement silver plated using for the procedure an apparatus assembly similar to that shown in the Drawing for mounting and treatment of the bodies. Each of the discs was made of commercial pressed and sintered powdered nickel electrode stock obtained from GOULD, Inc. of Cleveland, Ohio. They were of ½ inch (ca. 1.27 cm) diameter with nominal average pore sizes of 10 microns. Discs of both 50 mils (ca. 0.127 cm) and 70 mils (ca. 0.178 cm) thickness were employed.

In the first acid treating step of each of the tests, the etching acid was applied by dropping on the mounted disc. A vacuum was then applied; and the disc subsequently washed thoroughly with water. Various acid treatments were attempted using 5 and 10 ml portions of 3 N, 6 N, and concentrated HCl, plus 10 ml portions of 25%, 50% and concentrated $H_3PO_4$ on the 50 mil thick discs. For the thicker electrode discs, the amount of acid was increased in proportion to the body volume.

A standard aqueous silver plating solution (36 g/l AgCN, 66 g/l KCN, 15 g/l $K_2CO_3$) was used in the initial experiments to determine the best activation solution. Then, individual discs were plated as the second step of the operation using the following aqueous solutions:

| Test Solution | Contained g/l AgCN | Contained g/l KCN | Contained g/l $K_2CO_3$ |
|---|---|---|---|
| (A) | 30 | 60 | 15 |
| (B) | 30 | 60 | 0 |
| (C) | 60 | 60 | 15 |
| (D) | 60 | 60 | 0 |
| (E) | 60 | 30 | 15 |
| (F) | 60 | 30 | 0 |

A few experiments were performed using solution (F) with bath saturated in nickel cyanide ($Ni(CN)_2$).

Generally, the solutions were pumped through the discs for periods between 45 to 90 minutes. To determine the quality of the platings laid, each of the discs were broken in half and the exposed sections were microscopically examined under 70X magnification.

The quality of plating was evaluated in each instance by two criteria. The first was in terms of the approximate amount of silver deposited, as determined visually. In this connection, as the amount of silver laid in the plating increases, the appearance of the metal changes pronouncedly and in relatively direct correlation from black to silver-white. Some of the test discs, especially those etched with phosphoric acid and plated from solutions similar to Solution (A), showed minimum quantities of laid silver. Others, especially those from Solution (F), had very apparent and heavy, uniform silver deposits. The second criterion was evenness of deposition. Some of the discs, again those having phosphoric acid etchings and plated from Solutions (A), (C) and (E), tended to have somewhat spotty plating depositions. On the other hand, excellent uniformity was observed in the discs plated with Solution (F), especially after having been etched with hydrochloric acid.

The activation experiments with the various acid etching treatments showed that, while phosphoric acid was (and is) operable, the concentrated hydrochloric acid was (and is) a much better activator.

As explained in the foregoing, the presently contemplated two-step replacement plating process involves a displacement reaction. It is thus not surprising to find that the rate of silver deposition (i.e., plate laying speed) increases with increasing silver concentration in the solution. It would accordingly seem surmisable that very high silver concentrations would result in relatively high speed plating. However, in order to dissolve larger quantities of AgCN, larger quantities of KCN are required in order to provide enough $CN^-$ to form the soluble $Ag(CN)_2^-$ complex. In this, however, care should be taken to employ the minimum additional quantity of the extra KCN to merely achieve the desired $Ag(CN)_2^-$ complex. More than that required for this purpose may tend to undesirably cause increased and excessive cyanide attack of the nickel substrate. It was observed from the described testings that, while the plating speed was proportional to the KCN concentration, the high KCN concentrations tended to cause significant and greater than desirable corrosion of the nickel substrate. By way of elucidation of that, if KCN aids the dissolution of nickel, it should then also increase the plating speed due to the fact that the silver will deposit only when the nickel dissolves. It is, as is apparent, consequently necessary to compromise between plating speed and degree of attack of the substrate. To this end and for realization of that purpose, an aqueous solution of 60 g/l AgCN and 30 g/l KCN was found to be optimum.

The presence of $K_2CO_3$ in the solutions resulted in decreased plating speeds and somewhat less than optimumly desirable even deposits. In these plating solutions in normal electroplating, $K_2CO_3$ is known to increase the polarization at the anode and cathode. An increase in electrode polarization means a decrease in the rate of reaction (for a given voltage). This is consistent with the decreased plating speed observed in the tests (since the actual plating process by replacement plating actually involves localized anodes and cathodes).

It was also, and rather quite surprisingly and inexplicably, noted that slower flow rates resulted in faster plate laying speeds; this having been observed despite the fact that such a phenomenon appears to be inconsistent with the discernment that higher $Ag^+$ concentration increases the plating speed. That is to say (and for reasons incompletely comprehended), the $Ag^+$ concentration tends to remain constant (rather than being locally depleted) as more solution is swept during the second replacement plating step through the substrate.

Finally, the presence of added $Ni(CN)_2$ was noted to decrease the plating speed. Since $Ni^{+2}$ is known to exist in cyanide solution as the complex $Ni(CN)_4^{-2}$, it follows that the free $CN^-$ concentration decreases as the $Ni^{+2}$ concentration increases. This should tend to decrease the plating speed, especially in the light of the aforementioned observation that the plating speed is directly proportional to the $CN^-$ concentration. This effect is important for practical purposes. It means, which should be taken into proper account, that the plating speed of a given bath will decrease with its usage.

From the experimentations above set forth, it can be seen that, for replacement silver plating of the total interior surface of porous nickel bodies using cyanide based plating solutions, the plate laying speed is directly proportional to the $Ag^+$ and $CN^-$ concentrations, and inversely proportional to the plating solution flow rate and the $Ni^{+2}$ and $K_2CO_3$ concentration. Further, higher concentrations of KCN attack the nickel substrate. Thus, utilization of an HCl activation first step followed by use of a relatively slow flow of an about 60 g/l AgCN–30 g/l KCN aqueous solution in the second step can be depended upon to give reliably good and uniform silver deposition in reasonably short periods of time.

Many changes and modifications can readily be made and adapted in embodiments in accordance with the present invention without substantially departing from its apparent and intended spirit and scope, all in pursuance and accordance with same as it is set forth and defined in the hereto appended claims.

What is claimed is:

1. Two-step procedure for replacement plating silver on at least the interior surface areas of a porous nickel substrate body comprising:

as the first step, etching the surface areas of the porous nickel body over which silver plate is to be laid with an aqueous solution of a mineral acid capable of removing oxide deposits from the nickel on bare elemental nickel on said surface areas to activate same; then subsequently and as the second step, contacting the activated nickel surface areas with an aqueous plating solution of a silver salt capable of laying silver plate by displacement of nickel in the substrate and replacement thereof with silver from the solution.

2. The essential procedure of claim 1 and including, in addition thereto and in combination therewith, thoroughly water washing the acid etched body as part of said first step to render it free from acid prior to performance of said second plate laying step.

3. The procedure of claim 1, wherein the acid is hydrochloric of at least one (1) Molar strength.

4. The procedure of claim 1, wherein the acid is concentrated hydrochloric.

5. The procedure of claim 1, wherein the plating solution is comprised of silver cyanide as the essential plating agent in said solution.

6. The procedure of claim 1, wherein the plating solution is comprised of a mixture of silver cyanide and an alkali metal cyanide.

7. The procedure of claim 1, wherein the plating solution is comprised of a mixture of silver cyanide and potassium cyanide containing at least about 30 g/l AgCN and not more than about 75 g/l KCN.

8. The procedure of claim 1, wherein the plating solution is comprised of a mixture of silver cyanide and potassium cyanide in a respective Molar ratio of at least about 1:1 of AgCN to KCN.

9. A procedure according to the procedure of claim 8, wherein said plating solution contains about 60 g/l AgCN and about 30 g/l KCN.

10. The procedure of claim 1, wherein the porous nickel substrate body to be plated is a sintered, fabricated powder metal form adapted to electrode usage having pores therein with an average nominal pore diameter in the range of from about 0.1 micron to about 25 microns.

* * * * *

UNITED STATES PATENT AND TRADEMARK OFFICE

CERTIFICATE OF CORRECTION

PATENT NO. : 4,189,510

DATED : February 19, 1980

INVENTOR(S) : James A. McIntyre, et al.

It is certified that error appears in the above-identified patent and that said Letters Patent are hereby corrected as shown below:

Col. 3, line 63, delete "by" and insert therefor --be--.

Col. 3, line 65, delete "akali" and insert therefor --alkali--.

Col. 4, line 11, delete "AG" and insert therefor --Ag--.

Col. 4, line 44, delete "concentrations" and insert therefor --concentration--.

Signed and Sealed this

*Tenth* Day of *June 1980*

[SEAL]

*Attest:*

SIDNEY A. DIAMOND

*Attesting Officer*

*Commissioner of Patents and Trademarks*